US011001760B2

(12) United States Patent
Corscadden et al.

(10) Patent No.: US 11,001,760 B2
(45) Date of Patent: May 11, 2021

(54) ASPHALTENE CONVERSION, SEPARATION, REMOVAL AND TRANSPORT PREPARATION FOR HEAVY HYDROCARBONS

(71) Applicant: SUNCOR ENERGY INC., Calgary (CA)

(72) Inventors: Tom Corscadden, Calgary (CA); David Denton, Calgary (CA); Jim Kearns, Calgary (CA); Darius Remesat, Calgary (CA)

( * ) Notice: Subject to any disclaimer, the term of this patent is extended or adjusted under 35 U.S.C. 154(b) by 174 days.

(21) Appl. No.: 16/006,651

(22) Filed: Jun. 12, 2018

(65) Prior Publication Data

US 2019/0023990 A1 Jan. 24, 2019

Related U.S. Application Data

(60) Provisional application No. 62/534,536, filed on Jul. 19, 2017.

(51) Int. Cl.

| | |
|---|---|
| ***C10C 3/14*** | (2006.01) |
| ***C10G 55/04*** | (2006.01) |
| ***C10L 5/10*** | (2006.01) |
| ***C10G 21/00*** | (2006.01) |
| ***C10L 5/04*** | (2006.01) |

(52) U.S. Cl.

CPC ..... *C10C 3/14* (2013.01); *C10G 21/003* (2013.01); *C10G 55/04* (2013.01); *C10L 5/04* (2013.01); *C10L 5/10* (2013.01)

(58) Field of Classification Search

CPC ..... C10G 9/36; C10G 21/003; C10G 55/04; C10C 3/14

See application file for complete search history.

(56) References Cited

U.S. PATENT DOCUMENTS

| | | | |
|---|---|---|---|
| 3,639,322 | A | 2/1972 | Bathgate et al. |
| 3,655,350 | A | 4/1972 | Utley |
| 5,916,826 | A | 6/1999 | White |
| 6,440,205 | B1 | 8/2002 | Bailey et al. |
| 7,101,499 | B1 | 9/2006 | Bronicki et al. |
| 9,150,794 | B2 | 10/2015 | Corscadden et al. |
| 2012/0151834 | A1 | 6/2012 | Duyvesteyn et al. |
| 2013/0036714 | A1 | 2/2013 | Bolton et al. |
| 2017/0226320 | A1 | 8/2017 | Mariotti et al. |

FOREIGN PATENT DOCUMENTS

| | | |
|---|---|---|
| CA | 2958443 | 4/2017 |
| GB | 2134537 | 8/1984 |

*Primary Examiner* — Renee Robinson

(74) *Attorney, Agent, or Firm* — Bradley Arant Boult Cummings; Timothy L. Capria; Alexandra C. Lynn

(57) ABSTRACT

A process to convert asphaltenes found in heavy hydrocarbon sources, remove the converted solid asphaltene portion from the hydrocarbon source at operating conditions and to prepare the separated solid asphaltenes for easier handling, storage or bulk transport, with a minimal amount of heavy hydrocarbon remaining with the asphaltenes to serve as an inherent binder for larger and robust formed solid asphaltene pieces.

18 Claims, 1 Drawing Sheet

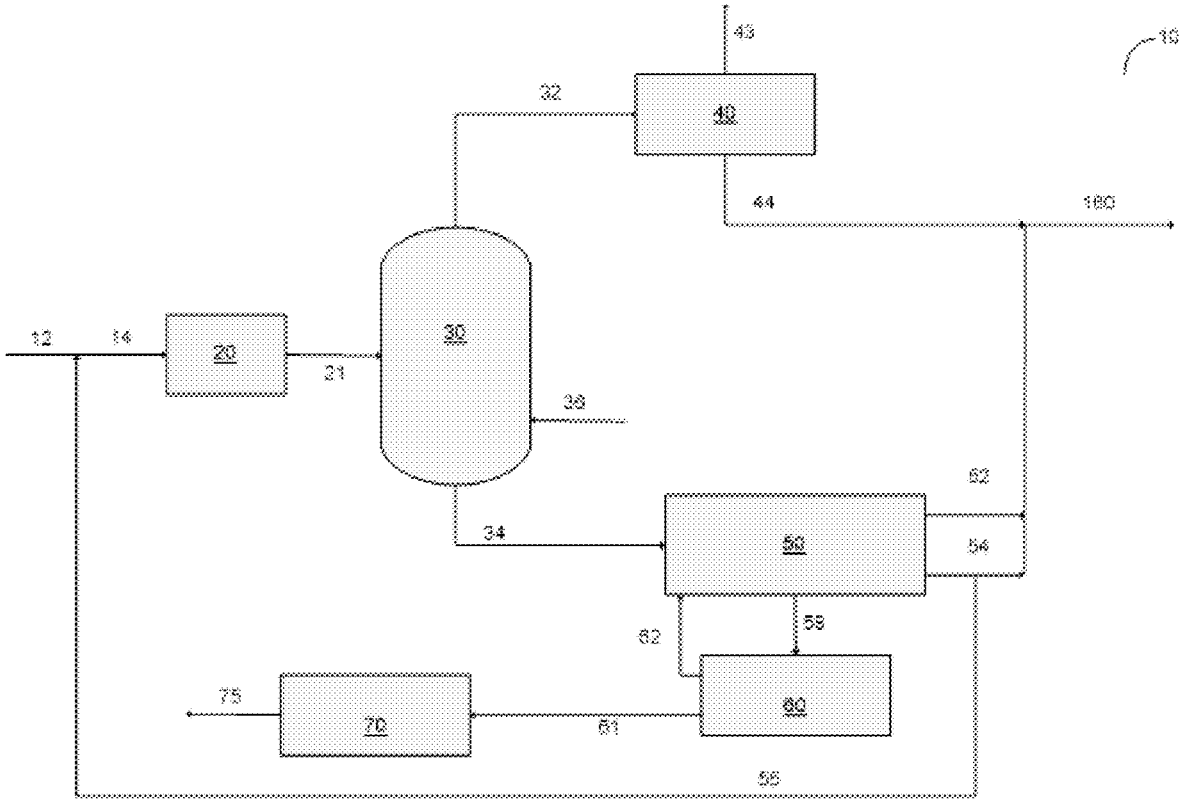
10
12
14
20
21
30
32
40
43
44
100
36
34
50
52
54
58
62
60
61
70
75
55

ASPHALTENE CONVERSION, SEPARATION, REMOVAL AND TRANSPORT PREPARATION FOR HEAVY HYDROCARBONS

FIELD OF THE INVENTION

A process to convert asphaltenes found in heavy hydrocarbon sources, remove the converted solid asphaltene portion from the hydrocarbon source at operating conditions and to prepare the separated solid asphaltenes for easier handling, storage or bulk transport, with a minimal amount of heavy hydrocarbon remaining with the asphaltenes to serve as an inherent binder for larger and robust formed solid asphaltene pieces.

DESCRIPTION OF PRIOR ART

U.S. Pat. No. 3,655,350 describes a process to produce a coal pellet containing fine particles of coal, and a coal tar pitch binder having a softening point between 90° F. (32.2° C.) and 190° F. (87.8° C.). The coal pellet is produced by spraying coal tar pitch heated to a temperature between 300° F. (148.9° C.) and 600° F. (315.6° C.) onto fine particles of coal having a moisture content of between 12% and 30% in a mixing vessel, pelletizing the resultant mixture and drying the pellets to the desired moisture content. This patent uses an externally applied binder applied through a spray involving a virgin hydrocarbon based.

U.S. Pat. No. 5,916,826 produces a coal agglomerate by the combination of coal fines with a binder obtained by the direct liquefaction of biomass material. The direct liquefaction is carried out in the absence of oxygen at typical temperatures between about 450 and 700° F. (232.2 to 371.1° C.) and typical pressures between 200 and 3,000 psi (1,380 to 20,690 kPa), according to known liquefaction processes. The resulting well mixed mass is then pelletized by the application of pressure in conventional equipment. External binders are used to obtain the agglomerate.

U.S. Pat. No. 7,101,499 shares an apparatus for producing pellets from hot heavy hydrocarbon or asphaltene that supplies the hot heavy hydrocarbon or asphaltene through a conduit to its outlet; and pellet producing medium or means that breaks up the liquid stream of the hot asphaltene flowing out of the outlet of the conduit and produces pellets of asphaltene. The feedstock in this patent is a liquid asphaltene.

U.S. Pat. No. 6,440,205 discloses an advanced use of rotating drums to dry and make pellets and coated pellets from liquid phase asphalt materials. The feedstock is a liquid not a solid in the transport preparation step.

U.S. Pat. No. 9,150,794 shares a process that generates a solid asphaltene at operating conditions producing a dry solid asphaltene powder with minimal DAO content. This patent does not provide for an agglomeration step reducing the utility of the solid asphaltene generated in the process.

U.S. Patent application 20120151834 shares a method for pyrolyzing asphaltene material that includes providing a composition including from 50 to 90 wt % asphaltene material and from 50 to 10 wt % inert material, and pyrolyzing the composition. The patent indicates that forming asphaltene pellets can also be used in order to improve asphaltene pyrolysis. The forming of the pellets involves an externally provided inert and/or organic binding agent up to between 10 and 50 wt %. Processing the heavy hydrocarbon occurs after pelletizing, also requiring an external binder over 10 wt %.

U.S. Patent application 20130036714 is a continuous process for fractioning, combining, and recombining asphalt sources into asphalt components for pelletization of asphalt and asphalt-containing products such that the pellets formed are generally uniform in dimension, freely flowing, free from agglomeration, and the pelletized asphalt is dried and/or packaged, and preferably compatibly packaged, for additional processing and applications. This patent requires a pre-pelletizing process (i.e. filtering) and a drying and/or packaging step. Also, the patent refers to the Asphalt as a solid or liquid requiring filtering and heating/cooling to obtain the necessary viscosity and consistency for feed to the pelletizer. The feedstock to the transport preparation step (i.e. pelletizing) is essentially a liquid (with a softening point) teaching away from a solid generated in the asphaltene removal step.

Many concepts have been developed that use additives such as hydrocarbons or polymers to create solid transportable shapes from bitumen. As an example of this concept, U.S. Patent application 20170226320A1 teaches the generation of bitumen pellets by including at least one chemical additive chosen from: a compound of general formula (I): R1-(COOH)z in which R1 is a linear or branched, saturated or unsaturated hydrocarbon-based chain including from 4-68 carbon atoms, and z is an integer ranging from a compound of general formula (II): R—(NH)nCONH—(X)m-NHCO(NH)n-R' in which: R and R' are identical or different, contain a saturated or unsaturated, linear or branched, cyclic or acyclic hydrocarbon-based chain having from 1-22 carbon atoms and optionally including heteroatoms and/or rings having from 3-12 atoms and/or heterocycles having from 3-12 atoms; X contains a saturated or unsaturated, linear or branched, cyclic or acyclic hydrocarbon-based chain having from 1-22 carbon atoms and optionally including one or more heteroatoms and/or rings having from 3-12 atoms and/or heterocycles having from 3-12 atoms; n and m are integers having, independently of one another, a value of 0 or of 1. These concepts use as much as the bitumen molecule as possible which teaches away from extracting as much as the separable oil before agglomeration of concentrated asphaltenes occurs.

SUMMARY OF THE INVENTION

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

Essentially, an improved process for producing both a pipeline-ready crude and refinery feedstock and an agglomerated solid asphaltene product from heavy crude oils, such as Canadian Oil Sands bitumen, is described, with said process consisting of: (1) optimal asphaltene conversion with minimum coke and offgas make in a full bitumen stream within a reactor to produce: a thermally affected asphaltene-rich fraction; a minimum non-condensable vapour stream; and an increased refinery-feed liquid stream; (2) deasphalting said thermally affected asphaltene-rich fraction into a refinery-feed liquid stream and a concentrated solid asphaltene stream at operating conditions; (3) Selectively converting specific hydrocarbon components as required for pipeline specification, finally blending of all the liquid streams to produce a refinery feed; (4) inertial separation of the concentrated solid asphaltene stream; and (5) agglomeration of the solid asphaltene to reduce volume and dust for transport to a gasifier, power, cement or asphalt plant or other solid carbon based application.

The bitumen is thermally treated to remove and convert/crack selected asphaltenes, which are then sufficiently separated in a more efficient solvent liquid-solid extraction process, reducing production of coke and isolating undesirable contaminants (like metals, MCR, and remaining asphaltenes).

Considering the relative complexity and high degree of side chains on the Canadian bitumen asphaltenes, under the operating conditions of the invention disclosed here, the side chains are preferentially cleaved from the core asphaltene molecule to make desired vacuum gas oil to light hydrocarbon range components. The remaining polyaromatic asphaltene cores remain solid at elevated temperatures and pressures above operating conditions and thus separate more readily than non-thermally affected asphaltenes resulting in improved separation and removal processes, such as liquid-solid solvent deasphalting (50) and vapour-solid separation like inertial separation (60) leading to more effective transport preparation agglomeration (70).

Further, the heavier hydrocarbons in the bitumen are also mildly cracked to vacuum gas oil, gasoline and distillate boiling range components, all desirable for separation and conversion in refineries. Any major deviations in temperature and heat flux within the bitumen pool in the reactor will lead to coking and increased gas yield and a reduction in the overall crude yield of the original bitumen, and reduced reliability of the operation, increasing the operating cost of the facility.

The invention provides improved apparatus and method for producing both a pipeline-ready and refinery-ready feedstock and agglomerated solid asphaltene product from heavy, high asphaltene crudes (for example, Canadian bitumen), and feedstocks, with utility for any virgin or previously processed hydrocarbon stream, the process and apparatus comprising a pre-heater for pre-heating a process fluid to a design temperature at or near the desirable operating temperature of a reactor; moving the process fluid into the reactor for conversion of the process fluid by controlled application of heat to the process fluid in the reactor so that the process fluid maintains a substantially homogenous temperature throughout the reactor, to produce a stream of thermally affected asphaltene-rich fractions, a stream of liquid hydrocarbon and a vapour stream with minimal non-condensable vapour. The stream of vapour is separated into two further streams: of non-condensable vapour, and of light liquid hydrocarbons. The thermally affected asphaltene-rich fraction is deasphalted, using a liquid-solid solvent extraction process, into streams of deasphalted oil liquid, and concentrated solid asphaltene, respectively. The deasphalted oil liquid and the light liquid hydrocarbons produced in the processes are blended to form a pipeline and refinery-ready feedstock. The concentrated solid asphaltene is processed in a vapour-solid separation unit (e.g. inertial) to create a dry solid asphaltene product with inherent binder that can be readily agglomerated in an improved transport preparation unit.

The resulting concentrated thermally-affected asphaltenes can be successfully processed in a vapour-solid separator such as a centrifugal collector, settling chamber or inertial separator to generate a dry, solid asphaltene by-product for aggregation for transport preparation.

The agglomeration can be successfully achieved in volume reduction devices such as extruders, briquetters and pelletizers to create a transport ready solid asphaltene product with size and integrity suitable for transport, storage and handling which is more amenable than dealing with powdered fine particulate asphaltene.

BRIEF DESCRIPTION OF DRAWINGS

FIG. 1 depicts the process for processing heavy hydrocarbons with asphaltenes, separating the solid asphaltenes and preparing the solid asphaltenes for bulk transport.

INTRODUCTION TO THE INVENTION

In the process of developing a pipelineable bitumen product, a solid powder asphaltene product can be created. The solid asphaltene particles are generated at operating conditions within the heavy hydrocarbon processing operation. The asphaltenes are thermally affected, enabling improved separation during the solid-liquid extraction process. The solid asphaltenes are gathered in a bed and then separated from the resin/DAO and solvent. The solid asphaltene powder, noted as HI-Q® solid asphaltene in Table 1, consists of very small particles in the range of 40-200 μm. The HI-Q® solid asphaltenes to be agglomerated in the transport preparation step do not have a melting or softening point below their pyrolysis point, similar to coal dust and carbon black, yet contain a small amount of resin/DAO that acts as an inherent binder (in contrast to coal dust and carbon black). In comparison to asphaltenes from state-of-the-art solvent deasphalting, noted as liquid asphaltene pitch in Table 1, liquid asphaltene pitch does have a melting and softening point, and is a liquid at the conditions of the separation and removal step due to high concentration of resin/DAO.

TABLE 1

Properties of select materials that can be agglomerated

| Material | Melt Point (° C.) | Softening Point (° C.) | Nominal Size (um) | Resin/ DAO % | Inherent binder |
|---|---|---|---|---|---|
| Liquid Asphaltene Pitch | >200 | >120 | 10-1000 when solidified | ~30-70 wt % | Yes |
| Coal Dust | None | None | 60-240 | 0 | No |
| Carbon Black | None | None | 80-800 | 0 | No |
| Clay | None | None | 1-4 | 0 | No |
| HI-Q ® Solid Asphaltene | None-above pyrolysis point | None-above pyrolysis point | 40-200 | <7-10 wt % | Yes |

Dust and handling of the small particles can be a challenge with agglomeration providing an opportunity to reduce the handling volume of the solid asphaltenes and suppressing the tendency for dust formation. With the unique properties of the HI-Q® solid asphaltene, an agglomeration method with the appropriate combination of temperature and pressure can be applied to create an effective conversion, separation, removal and transport preparation process for heavy hydrocarbon.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

FIG. 1 is a process flow diagram depicting a process 10 for forming a hydrocarbon liquid product 160 and an agglomerated solid asphaltene rich product 75 from a hydrocarbon feedstock 12, where the final hydrocarbon product 160 has sufficient characteristics to meet minimum pipeline transportation requirements (minimum API gravity of 19) and is a favourable refinery feedstock while the final solid product 75 has sufficient characteristics to be shipped by truck, rail or marine vessel for use as a replacement feedstock for coal based applications.

A process fluid 14 formed from a feedstock 12 of heavy hydrocarbon can be routed through a heater 20 to heat the process fluid 14 to a desired temperature level before it is routed to a reactor 30 where the process fluid 14 is controlled and maintained while it undergoes a mild controlled cracking process. After the mild cracking process, a light overhead fraction 32 can be routed from the reactor 30 to a gas liquid condensing separator and olefin saturation process 40 and a heavy bottom fraction 34 can be routed to a high performance solvent extraction process 50. Some of the outputs from the gas liquid condensing separator and olefin saturation process 40, i.e., the liquid product stream 44, can be blended with some of the outputs of the high performance solvent extraction process 50, namely an extraction oil stream 52 and a resin stream 54, to result in a final hydrocarbon product 160 that has sufficient physical characteristics to enable it to meet the required pipeline transport criteria without having to mix the final hydrocarbon product 160 with diluents from external sources, or requiring much reduced volumes of such diluent.

The feedstock 12 can be a heavy hydrocarbon (virgin or a previously processed stream), such as the heavy hydrocarbon obtained from a SAGD (steam assisted gravity drainage) process, for example Canadian Oil sands bitumen, or from any other suitable source of heavy hydrocarbon. In one aspect, the feedstock 12 can have an API gravity in the range of 0 to 14.

In one aspect, a recycled portion 55 of the resin stream 54 output from the high performance solvent extraction process 50 can be blended with the incoming feedstock 12 to form the process fluid 14 that passes through process 10. The resin stream may be added to the process fluid in instances in which further crude yield, and/or lighter crude, and/or asphaltene suppression is desired in order to meet treated product characteristic targets. The resin recycle provides the operator with flexibility, through an adjustable flow parameter, to meet production specifications, and allows the plant to handle feedstock variations robustly.

The resin product 54 from the solvent extraction process 50 will typically have a relatively low API gravity. In one aspect, the API gravity of the resin product 54 can have an API gravity between 0 and 10. Depending on the characteristics of the feedstock 12 and the amount of resin product 54 blended with the feedstock 12, the resulting process fluid 14 can have a range of characteristics and particularly a range of API gravities.

The process fluid 14 (obtained entirely from the feedstock 12 or formed as a blend of feedstock 12 and resin stream 54 from the solvent extraction process 50) can be routed to the heater 20 where the process fluid 14 can be heated to a desired temperature as it passes through the heater 20 before being routed as stream 21 to the reactor 30 to undergo mild thermal cracking. Reactor 30 maintains a consistent fluid temperature through a uniform application of heat throughout the reactor to allow for mild thermal cracking to occur without coking being a concern or detrimental to the operation and/or performance of the reactor 30.

In one aspect, the heater 20 will heat the process fluid 14 to a temperature between 675-775° F. before the process fluid 14 is introduced into the reactor 30.

In the reactor 30, the process fluid 14 (heated to between 675-775° F. by the heater 20) undergoes a mild controlled cracking process. Appropriately located heaters are provided in this reactor 30 to maintain the desired constant temperature generated in heater 20 and to apply uniform heat flux for the fluid 14. The heaters provide indirect heat through any source readily available (electric, heat transfer fluid, radiant etc.). To ensure a uniform heat flux, mixing can be applied to the process fluid on a continuous or intermittent basis.

The reactor 30 can be operated in a manner, through optimizing primarily five inter-related process variables (Temperature, Pressure, Residence Time, Sweep Gas and Heat Flux), so as to reduce or even prevent coke from forming during the reaction, and minimizing gas production, while also providing optimal conversion of the asphaltene portion of the heavy hydrocarbon to refinery-ready feedstock components.

The first and second variables involve applying a uniform heat flux between 7000-12000 BTU/hr sq.ft to the entire pool of process fluid in the reactor and maintaining a single operating temperature in the reactor between 675-775° F. This may be achieved by the presence of appropriately sized and located heating devices in the reactor. The number of heaters will be set by calculating the optimal dispersion of heat between any two heaters so as to have a uniform temperature throughout the pool and to avoid peak or spot temperatures significantly higher than the target temperature in the reactor.

The third reactor variable, residence time, can be between 40-180 minutes in the reactor.

The fourth reactor variable, operating pressure, can be maintained at near atmospheric pressure, in any case, to be less than 50 psig, with standard pressure control principles used for consistent performance. The pressure range is controlled on the low end to prevent excessive, premature flashing of hydrocarbon, essentially bypassing the reactor, and limited on the high end to reduce secondary cracking and consequent increased gas yields.

The fifth reactor variable, hot sweep gas 36, in the same temperature range as the process fluid (675-775° F.) 21, may be added to the process fluid 14 in the reactor 30 in the range of 20-80 scf/bbl.

The sweep gas 36 can be natural gas, hydrogen, produced/fuel gas from the process, steam, nitrogen or any other non-reactive, non-condensable gas that will not condense to a liquid.

Sweep gas in the dosage of 20-80 scf/bbl of feed is provided to remove the "lighter" hydrocarbon products (i.e. methane to <750° F. boiling point hydrocarbons) as soon as they are formed in the reactor 30 so that there is a minimum of secondary cracking which could increase gas make and potentially increase olefinic naphtha/distillate production.

The sweep gas may also allow the reactor to operate closer to the desired operating pressure (<50 psig) and temperature. The sweep gas 36 can also be used to provide additional heat and/or mixing to the process fluid 14 in the reactor 30.

As discussed with respect to the FIGURE, the heat energy stream, for reactor 30 is uniformly (7000-12000 BTU/hrsq.ft) applied throughout the hydrocarbon residence time (40-180 minutes) in the reactor 30 at the desired temperature (675-775° F.) and pressure (less than 50 psig) to minimize any local peak fluid temperatures which can initiate coking, and thereby allowing an increased thermal transfer of heat at a higher bulk temperature improving the conversion of hydrocarbons within reactor 30. At these operating conditions, the reaction kinetics favour optimum conversion of the asphaltenes that may preferentially cleave the outlying hydrocarbon chains creating desirable hydrocarbons (VGO and diesel range hydrocarbons) for the refiner without causing coking or increased gas production in the reactor. As an example, Table 2 illustrates different configurations of asphaltenes for different types of crudes. The proposed operating conditions of reactor 30 factor in the relative complexity and high degree of side chains on different crudes.

TABLE 2

Average molecular structures representing asphaltene molecules from different sources: A, asphaltenes from traditional heavy crudes; B, asphaltenes from Canadian bitumen (Sheremata et al., 2004).

A

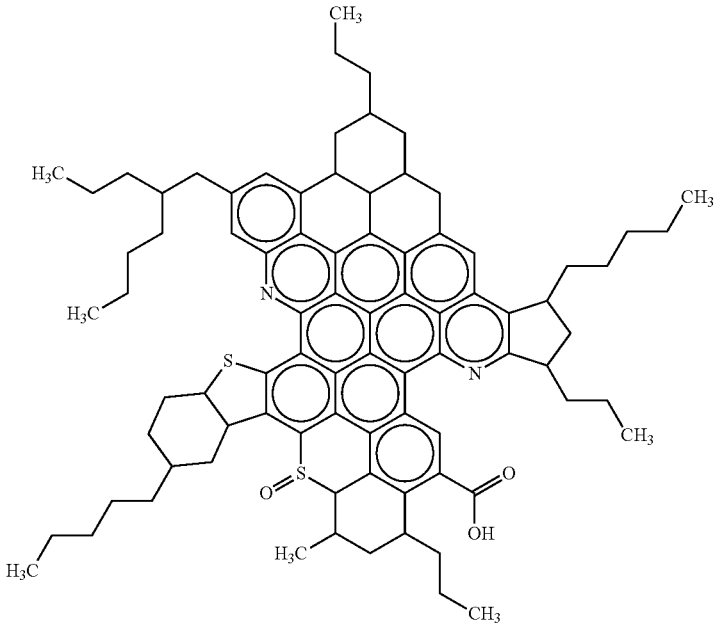

B

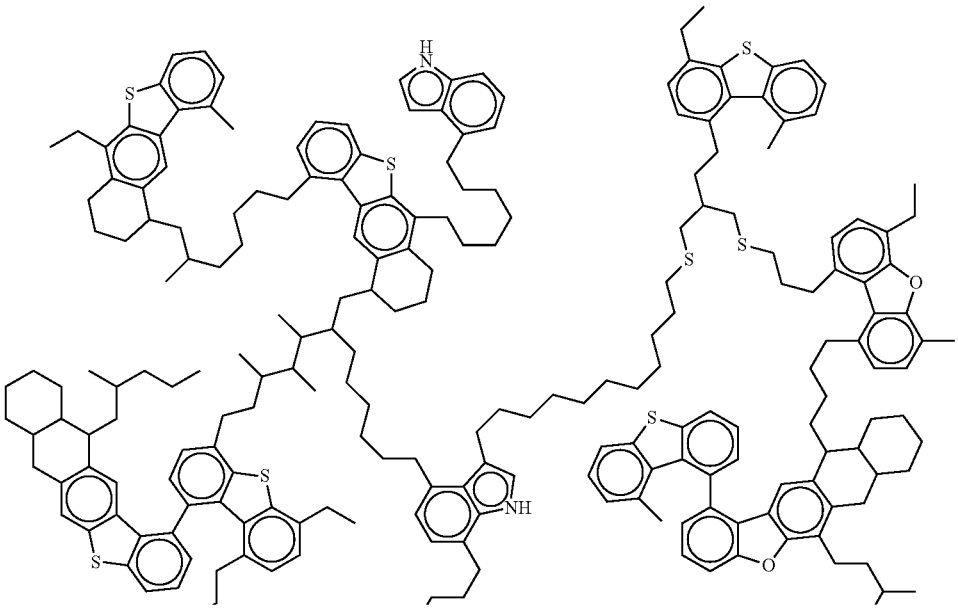

TABLE 2-continued

Average molecular structures representing asphaltene molecules from different sources: A, asphaltenes from traditional heavy crudes; B, asphaltenes from Canadian bitumen (Sheremata et al., 2004).

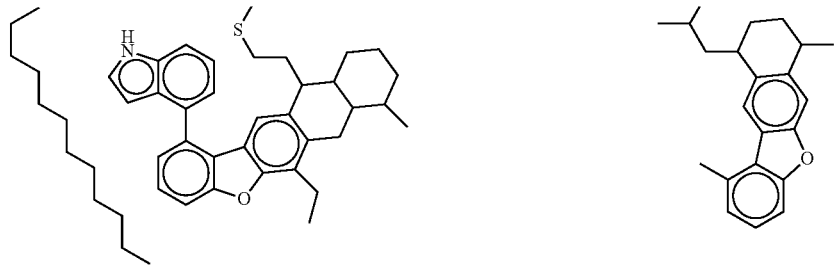

Each variable may be changed independently, within the ranges suggested, based on the quality of feedstock provided or based on the quality of output desired. Since the 5 noted process variables are inter-related, a multi-variable process control scheme with a prescribed objective function (maximum yield to meet minimum product specifications) will be beneficial to ensure the process operates at an optimal point when any one of the variables is changed or the feed/product situation is altered.

Once the process fluid 14 has remained in the reactor 30 for a sufficient amount of time so that the characteristics of the outputs of the reactor 30 reach desired qualities, a light overhead fraction 32 and a heavy bottoms fraction 34 can be removed from the reactor 30.

The light overhead fraction 32 of the output from the reactor 30 can contain non-condensable vapor products, light liquid hydrocarbon and heavier liquid hydrocarbon. The vapor products can be vapors released from the process fluid 14, such as sour gas, while undergoing thermal cracking, as well as introduced and unconverted or unused sweep gas 36 that has passed through the reactor 30.

The overhead liquid fraction 32 will have a much higher API gravity than the bottom fraction 34. For example, the overhead liquid fraction 32 could typically have an API gravity of 26 or greater. The overhead fraction 32 can be directed to a gas liquid condensing separator and olefin saturation process 40, which can comprise a cooler and a separation drum, as an example, in which a portion of the overhead liquid fraction 32 that is a condensable liquid product containing naphtha and heavier hydrocarbons can be separated from the gaseous components of the overhead fraction 32. An off-gas line 43 containing undesirable gases such as sour gas, can be provided at the separation drum for those gases to be disposed of, recycled, or subjected to further treatment.

One or more liquid hydrocarbon streams can be produced from the separation drum. The liquid product stream 44 can be sent to product blending.

The bottom fraction 34 can contain hydrocarbons, and modified asphaltenes. Although the characteristics of the bottom fraction 34 taken from the reactor 30 will vary depending on the process fluid 14 input into the reactor 30 and the reactor's operating parameters, in one aspect the bottom fraction 34 can have an API gravity ranging between −5 and 5.

Controllable process variables allow an operator to vary the performance of the reactor 30 to meet the needs of the final product based on changing characteristics of the incoming process fluid 14.

The controllability of the five inter-related variables, residence time, sweep gas, heat flux, temperature and pressure in the reactor 30 allow an operator to vary the performance of the reactor 30.

In this manner, when the characteristics of the feedstock 12 are changed either as different fresh feed or more or less resin recycle 55, the five inter-related process variables can be optimized to avoid the production of coke and minimize the production of non-condensable vapors which are produced in the reactor 30. For example, the operator can vary the residence time of the process fluid 14 in the reactor 30 based on the characteristics of the process fluid 14 to obtain the desired yields and/or quality of the outputs of the reactor 30, namely the light overhead fraction 32 and the heavy bottom fraction 34. Alternatively, the operator can vary the sweep gas, temperature or pressure to achieve similar outcomes. The process variables are interrelated and the minimization of coke and avoidance of excess gas make is challenging and is best determined by pilot operations.

The bottom fraction 34 from the reactor 30 can be fed to a high performance solvent extraction process 50 that can produce a thermally affected solid asphaltene stream 58, an extracted oil stream 52 and a resin stream 54. The reactor 30 is operated in a manner that significantly limits and even prevents the formation of coke and reduces gas production while converting asphaltenes into more suitable components for downstream processing. Consequently, modified asphaltenes and other undesirable elements remain in the bottom fraction 34 that is removed from the reactor 30. An example of the above process is noted in U.S. Pat. No. 9,200,211 and Canadian patent 2,764,676.

To maximize the recovery of the desirable refinery feedstock crude the undesirable elements that remain in the bottom fraction 34, the bottom fraction 34 from the reactor 30 must be further treated using, for example, a high performance solvent extraction process 50. The treatment of the bottom fraction 34 by solvent extraction process 50 allows the reactor 30 and the solvent extraction process 50 to be used in conjunction, to produce a suitable full range refinery feedstock crude and a solid asphaltene product for agglomeration for transport, with minimal suitable refinery feedstock comprising part of the asphaltene agglomerate.

The solvent extraction process 50 can comprise any suitable solvent extraction process that can handle the separation of precipitated solids at operating conditions from the remaining hydrocarbon liquid. An example of a relevant liquid-solvent separation process is U.S. Pat. No. 9,976,093 and Canada patent 2,844,000. Alternatively, in one aspect, it can be a three stage super-critical solvent process that separates the asphaltenes from the resins in the bottom fraction 34. The output of the solvent extraction process 50 can be an asphaltene stream 58, an extracted oil stream 52 and a resin stream 54. The asphaltene stream 58 is typically undesirable and is removed from the process 10. The extracted oil stream 52 can be of a relatively high quality, with an API gravity range of 9 to 15. The resin stream 54 is typically of a lower quality than the extracted oil stream 52, with an API gravity lower than the extracted oil stream 52. In one aspect, the resin stream 54 can have an API gravity in the range of 0 to 10 API gravity.

The extracted oil stream 52 and the resin stream 54 from the solvent extraction process 50 can be blended along with the liquid product stream 44 obtained from the gas liquid separator and olefin saturation unit 40 to form a final hydrocarbon product 160 meeting the specifications of the pipeline and/or the refinery. In one aspect, this final hydrocarbon product 160 would have an API gravity greater than 19. Typically, the final hydrocarbon product 160 would have a viscosity of 350 CentiStokes ("cSt") or less.

The resin stream 54 is typically of a lesser quality than the extracted oil stream 52. The recycle portion 55 of the resin stream 54 can be blended with the feedstock 12 to be reprocessed in order to form the final hydrocarbon product 160. As a result, this recycling portion of the resin stream will improve the quality of the final hydrocarbon product 160.

Stream 58 contains entrained liquid solvent and solid asphaltene particles at operating conditions. The pressure in stream 58 is preferably reduced prior to unit 60 to flash the entrained solvent into the vapour phase creating a vapour-solid stream which is typically easier to separate than a comparable liquid-solid stream. The vapour-solid (e.g. inertial) separation unit 60, separates the asphaltene solids from the solvent vapour and gas remaining in stream 58 using one or more forces, such as centrifugal, gravitational, and inertial. These forces move the asphaltene solid to an area where the forces exerted by the gas stream are minimal. To here, an example of the process is U.S. Pat. No. 9,150,794. The separated solid asphaltene is moved by gravity into a hopper, where it is temporarily stored before moving to unit 70, asphaltene agglomeration unit, as stream 61. In an embodiment, stream 61 is close coupled between the temporary storage hopper of unit 60 and the feed to unit 70. In another embodiment, the temporary hopper in 60 directly feeds unit 70. Unit 60 can be either a settling chamber, baffle chamber or centrifugal collector; a device that provides separation of solid and gas. Centrifugal collectors can either be single or multi-staged cyclones. The solvent vapour and gas can be recycled to the solvent deasphalting process 50 as stream 62.

A pneumatic conveying system may transport solids up to approximately 50 mm in size. The solid must be dry, with no more than 20% moisture and not sticky. The thermally-affected asphaltene solids in stream 61 meet the above criteria and thus the process benefits from the ability to use an inertial separation unit, 60.

In a pneumatic conveying system, most of the energy is used for the transport of the gas itself. The energy efficiency of a pneumatic conveying plant is therefore relatively low, but this is often outweighed by easy handling and, in well designed systems, dust free solutions. In general the length of a pneumatic system should not extend 300 m for each pneumatic unit. The products can be conveyed over long distances by connecting the systems in series. There are three basic designs of pneumatic transport systems that can be considered for transporting stream 61 to unit 70:

dilute phase conveying at a high gas speeds (e.g. 20-30 m/s)

strand conveying at a limited gas speeds (e.g. 15-20 m/s)

dense phase conveying at a low gas speeds (e.g. 5-10 m/s)

In the desired event the SDA unit, 50, is overly effective in separating the asphaltenes from the resin, and DAO, stream 61 can have an organic or inorganic binder added to promote agglomeration. In practical terms, the DAO and resin remaining in stream 61 (~2-6 wt %) is sufficient to act as an inherent binder during the agglomeration step in unit 70.

The agglomeration step, unit 70, can include numerous state of the art machines that can pelletize, extrude, mix, compact or briquette produced solid asphaltene particles into larger agglomerated solid pieces of desired size and shape, useful (for example) for transport purposes or for ease of handling or storage. The appropriate combination of pressure (up to 2200 psig) and temperature (100-400° F.) can be applied by agglomeration forming equipment to activate the inherent (or an external) binder to create an extrudate that when exiting the machine can be conveyed by numerous methods including conveyor belts, stored in open storage bins and then transported by truck, rail or marine vessel without fracturing appreciably. Ideally, the extruded agglomerated solid can pass multiple drop tests before fracturing. The agglomeration apparatus is robust and flexible enough that a range of inherent binder concentrations can be tolerated to create an extrudate within specification to meet the drop test consistently.

In an embodiment, a state of the art extruder, a machine that creates objects of a fixed cross-sectional profile, is used to take the thermally affected solid asphaltene powder feedstock stream 61 and apply appropriate pressure and heat (to a desired range of temperature over a process timeframe) to form the extrudate. The feedstock is pushed through a die of desired cross-section (shape and size). Different die shapes can be employed to form agglomerated solid pieces of different dimensions. For example, solid cylinders of asphaltene varying in a diameter from 3" to 2-3 feet can be formed using different dies. The choice of extrudate shape and dimension depends on the storage, transport and the customer handling and processing requirements. A benefit of extrusion is that material only encounters compressive and shear stresses with a controlled amount of heat energy applied, minimizing the possibility of property modification of the asphaltenes. As a feature of the extruder, vacuum systems can be applied to the extruder to seal the upstream process equipment from the downstream storage and conveyance equipment to minimize the emission of vapour solvent into the downstream unit for both safety, and economic reasons. Thus, the extruder equipment can be part of an isolation function, isolating upstream processes and effluent from downstream portions of the process and process equipment associated with the extruder apparatus' output end.

In an extension to the state of the art extruder embodiment, two to a plurality of extruders can be installed in series with a vacuum collection chamber placed in between the extruders to capture any evolved hydrocarbons in the vapour phase. The evolved vapours can be returned to the process for further processing using a vacuum pump, blower or ejector.

In another embodiment, a state of the art briquetting machine can be used to form the asphaltene solid powder in stream 61 into larger agglomerated pieces. A briquetting machine applies pressure to particles by squeezing them between two rolls rotating in opposite directions. Cavities or indentations of various dimensions can be cut into the surfaces of the rolls to form the briquettes.

In another embodiment, a state of the art pelletizer, can be employed forming the solid asphaltene powder into a pellet, a ball or a granule in the presence of binder added during the process. The asphaltene powders or fines are typically moistened and rolled in an inclined, rotating drum or disc pelletizing apparatus, forming loose pendular, funicular and capillary bonds between the particles of the material, causing growth by packing, densification and layering, as the loose solids-air-binder bonds are replaced by dense solid-solid bonds with a "moisture" film between particles. As more fines are continuously fed into the pelletizer, roughly spherical pellets of desired size are discharged over the edge of the drum or pan, while smaller pellets and growing seeds are retained in the bottom. Pellet size is controlled by the angle and speed of the pelletizer, placement of the feed and location of the sprays, as well as the amount of liquid added at any given location. Thus the retention time and availability of dry fines and moisture can be controlled. The resulting pellets are uniform in size due to the natural classification action of the pelletizer.

EXAMPLE 1

An apparatus is provided for achieving a continuous process of forming useful solid pieces of agglomerated asphaltene powder produced in an earlier series of process steps, which apparatus extrudes cohesive, solid pieces of the thermally affected asphaltene powder, comprising:

a. An extruder barrel
b. An extruder screw disposed within the barrel
c. Feeding means at a feeding portion of the barrel to introduce a mixture of thermally affected asphaltene solid particulate powder and as required an extrinsic binder into the barrel
d. Means for driving the screw and powder in the barrel, rotating the screw and motivating the powder to travel under compression forces along the length of the barrel toward a discharge portion of the barrel a distance further along the length of the barrel
e. Die means disposed adjoining the discharge portion of the barrel for receiving and shaping the powder and any binder together as the powder is forced by the screw's motion out of the barrel at the discharge portion
f. Means to provide heat to the powder as the powder moves along and through the barrel.

Although various embodiments have been illustrated, it is to be appreciated that other variations are possible and that such variations will become apparent to the person skilled in the art in light of the present description.

What is claimed is:

1. A process for producing an agglomerated solid asphaltene product from a hydrocarbon feedstock, the process comprising:

thermally treating the hydrocarbon feedstock to convert the hydrocarbon feedstock to a thermally affected asphaltene-rich fraction;

solvent deasphalting the thermally affected asphaltene-rich fraction, comprising contacting the thermally affected asphaltene-rich fraction with a solvent to produce a deasphalted stream and a thermally affected solids-enriched asphaltene stream comprising thermally affected asphaltene solids;

separating at least a portion of the deasphalted stream from the thermally affected solids-enriched asphaltene stream;

flashing at least a portion of the solvent contained in the thermally affected solids-enriched asphaltene stream to produce a vapour-solids stream comprising the thermally affected asphaltene solids and vaporized solvent;

subjecting the vapour-solids stream to a vapour-solids separation to remove the vaporized solvent therefrom and produce a dry solid asphaltene particulate comprising 10% wt or less of residual resin and having a softening point above pyrolysis temperatures at atmospheric pressure; and agglomerating the dry solid asphaltene particulate to obtain the agglomerated solid asphaltene product, the agglomerating being performed at a pressure of between 100 psig and 2200 psig.

2. The process of claim 1, wherein the residual resin of the solid asphaltene particulate acts as an indigenous binder for agglomerating the solid asphaltene particulate.

3. The process of claim 1, wherein the agglomerating the solid asphaltene particulate further comprises heating the dry solid asphaltene particulate.

4. The process of claim 3, wherein the heating of the solid asphaltene particulate is performed at a temperature between 100° F. and 400° F.

5. The process of claim 3, wherein the agglomerated solid asphaltene product is capable of passing a standard drop test at least 5 consecutive times.

6. The process of claim 5, wherein the agglomerated solid asphaltene product comprises less than 2% wt of un-agglomerated asphaltene particles.

7. The process of claim 5, wherein the step of agglomerating the solid asphaltene particulate comprises adding an extraneous binder to the solid asphaltene particulate in an amount of less than 10% wt of the dry solid asphaltene particulate.

8. The process of claim 1, wherein the step of agglomerating the dry asphaltene solid particulate comprises a plurality of agglomerating steps performable in series, and the process further comprises capturing at least a portion of hydrocarbons in vapour phase in between two agglomerating steps.

9. The process of claim 1, wherein the solid asphaltene particulate comprises asphaltene particles, and between the $10^{th}$ and $90^{th}$ percentile of the asphaltene particles are in the range of 40-200 μm diameter.

10. The process of claim 1, wherein the solid asphaltene particulate comprises residual resin in an amount of less than 5% wt.

11. The process of claim 1, wherein the step of thermally treating the hydrocarbon feedstock comprises subjecting the hydrocarbon feedstock to a mild cracking process to produce a light fraction and the thermally affected asphaltene-rich fraction as a heavy fraction, and reducing or preventing formation of coke.

12. The process of claim 1, wherein the step of thermally treating the hydrocarbon feedstock comprises heating the hydrocarbon feedstock to a temperature of between 675° F. and 775° F. and subjecting the hydrocarbon feedstock to a pressure of less than 50 psig.

13. The process of claim 1, wherein the step of flashing comprises reducing the pressure of the thermally affected solids-enriched asphaltene stream to flash residual solvent from the thermally affected solids-enriched asphaltene stream.

14. The process of claim 1, wherein the step of agglomerating the solid asphaltene particulate to obtain the agglomerated solid asphaltene product comprises at least one of extruding, briquetting or pelletizing the solid asphaltene particulate.

15. The process of claim 14, wherein the step of extruding the solid asphaltene particulate is performed in an apparatus comprising:

an extruder barrel having an extruder barrel length and comprising a feeding portion and a discharge portion;

an extruder screw disposed within the extruder barrel and being configured to rotate and guide the solid asphaltene particulate to travel under compression forces along the extruder barrel length toward the discharge portion of the extruder barrel;

a feeder at the feeding portion of the extruder barrel to introduce solid asphaltene particulate into the extruder barrel;

a die disposed adjoining the discharge portion of the extruder barrel for receiving and shaping the solid asphaltene particulate in agglomerated units as the solid asphaltene particulate is forced by the extruder screw's rotation out of the extruder barrel at the discharge portion; and a heater to provide heat to the solid asphaltene particulate as the solid asphaltene particulate moves along the extruder barrel.

16. The process of claim 15, wherein the feeder is configured to receive an extraneous binder for introduction into the extruder barrel.

17. The process of claim 15, wherein the apparatus further comprises a vacuum system configured to seal the extruder barrel to reduce emission of at least a portion of hydrocarbons in vapour phase.

18. The process of claim 1, wherein subjecting the thermally affected asphaltene solids to a vapour-solid separation comprises subjecting the thermally affected asphaltene solids to an inertial separation.

* * * * *